US009056753B2

(12) United States Patent
Luntz et al.

(10) Patent No.: US 9,056,753 B2
(45) Date of Patent: Jun. 16, 2015

(54) DISABLING SYSTEM FOR AUTO-ARRESTING SAFETY DEVICE

(71) Applicant: LYNRUS ALUMINUM PRODUCTS, LLC, Salt Lake City, UT (US)

(72) Inventors: Matthew L. Luntz, Salt Lake City, UT (US); Kyle Peterson, Salt Lake City, UT (US)

(73) Assignee: LynRus Aluminum Products, LLC, Salt Lake City, UT (US)

( * ) Notice: Subject to any disclaimer, the term of this patent is extended or adjusted under 35 U.S.C. 154(b) by 315 days.

(21) Appl. No.: 13/655,329

(22) Filed: Oct. 18, 2012

(65) Prior Publication Data

US 2013/0277631 A1 Oct. 24, 2013

Related U.S. Application Data

(60) Provisional application No. 61/548,722, filed on Oct. 18, 2011.

(51) Int. Cl.

| | |
|---|---|
| ***B66D 1/48*** | (2006.01) |
| ***B66D 3/04*** | (2006.01) |
| ***A62B 35/00*** | (2006.01) |

(52) U.S. Cl.

CPC ..... *B66D 3/046* (2013.01); *A62B 35/0093* (2013.01)

(58) Field of Classification Search

USPC ..... 254/323, 268, 269, 276; 414/463–466; 224/42.23–42.27

See application file for complete search history.

(56) References Cited

U.S. PATENT DOCUMENTS

| | | | | |
|---|---|---|---|---|
| 2,990,131 | A | 11/1958 | Carlsson | |
| 4,099,685 | A | 7/1978 | Paitula | |
| 4,589,523 | A | 5/1986 | Olson et al. | |
| 4,877,110 | A | 10/1989 | Wolner | |
| 4,913,371 | A | 4/1990 | Margetts | |
| 5,220,977 | A | 6/1993 | Wolner | |
| 5,400,868 | A | 3/1995 | Ellis et al. | |
| 5,447,280 | A | 9/1995 | Feathers | |
| 5,771,993 | A | 6/1998 | Anderson et al. | |
| 5,829,548 | A | 11/1998 | Ostrobrod | |
| 6,279,682 | B1 | 8/2001 | Feathers | |
| 7,077,246 | B2 | 7/2006 | Timtner | |
| 7,210,645 | B2 | 5/2007 | Paterson et al. | |
| 7,461,727 | B2 | 12/2008 | Renton | |
| 2009/0032785 | A1 * | 2/2009 | Jones | 254/274 |
| 2009/0133977 | A1 | 5/2009 | Warren | |
| 2010/0236867 | A1 | 9/2010 | Jones et al. | |
| 2011/0147125 | A1 | 6/2011 | Blomberg | |

FOREIGN PATENT DOCUMENTS

| | | |
|---|---|---|
| WO | WO 2008/046446 | 4/2008 |

* cited by examiner

*Primary Examiner* — Emmanuel M Marcelo

(57) ABSTRACT

An auto-arresting safety device, comprising a housing; a fall arrest system supported by the housing, and having a first component moveable with respect to a second component, the fall arrest system being actuatable in response to a load to arrest movement of the first component relative to the second component, the fall arrest system being resettable to restore movement of the first component relative to the second component upon the load being at least partially removed; and a disabling system operable to prevent resetting of the fall arrest system upon the load exceeding a threshold load, such that, when actuated, the disabling system renders the safety device inoperable.

20 Claims, 16 Drawing Sheets

DISABLING SYSTEM FOR AUTO-ARRESTING SAFETY DEVICE

RELATED APPLICATIONS

This application claims the benefit of U.S. Provisional Application Ser. No. 61/548,722, filed Oct. 18, 2011, and entitled "Disabling System for Auto-Arresting Safety Device," which is incorporated by reference in its entirety herein.

FIELD OF THE INVENTION

The present invention relates generally to auto-arresting safety devices, sometimes referred to as strap lock devices, and more particularly auto-arresting safety devices having a manual or automatic resetting function.

BACKGROUND

Auto-arresting safety devices, sometimes referred to as strap lock devices, are safety systems commonly employed to prevent inadvertent falling of equipment and objects, notably gymnasium equipment. Perhaps one of the more common applications in which auto-arresting safety devices are employed is with basketball standards, and particularly those types of standards mounted and suspended from a ceiling or upper support, and that pivot from a use position to a raised storage position by way of a manual or motorized winch or crank system used to both raise and lower the standard, as well as to hold it in the upright stored position. In the event of a failure of the winch system (e.g., breaking of the support cables or failure of the winding mechanism, etc.) the supported equipment may fall, quickly accelerating into a downward motion that can present a highly dangerous situation. By employing an auto-arresting safety device, such falls are prevented as these devices activate to arrest the fall and prevent further movement of the object.

Once an auto-arresting safety device has been activated to arrest the fall of an object, it is not uncommon for these devices to be reset (either manually or automatically depending upon the type of device being used) and again be put into service. In many cases this is acceptable as long as the device has not experienced too great a load that would cause it to be inoperable, to fail, or to be less effective during a subsequent fall of the object. In many instances fall arrest indicators, such as flags, tabs, color coded devices, etc. are used to indicate that the device has been activated. However, such fall arrest indicators may be insufficient to maintain a safely operating device as these can be ignored or misunderstood. Indeed, upon activating to arrest a fall, if a prescribed or threshold load has been reached, such a device may no longer be safe for use. In practice, there is a reasonable probability that a person unqualified to determine the operational integrity of the device will deem it acceptable for continued operation. Or, such persons may decide that any device, no matter its condition or performance capability, is better in the interim than no device at all. In either case, such a flawed device may fail during a subsequent fall, resulting in the dangerous situation described above.

BRIEF DESCRIPTION OF THE DRAWINGS

Features and advantages of the invention will be apparent from the detailed description which follows, taken in conjunction with the accompanying drawings, which together illustrate, by way of example, features of the invention; and, wherein.

DETAILED DESCRIPTION

Figure 1A:
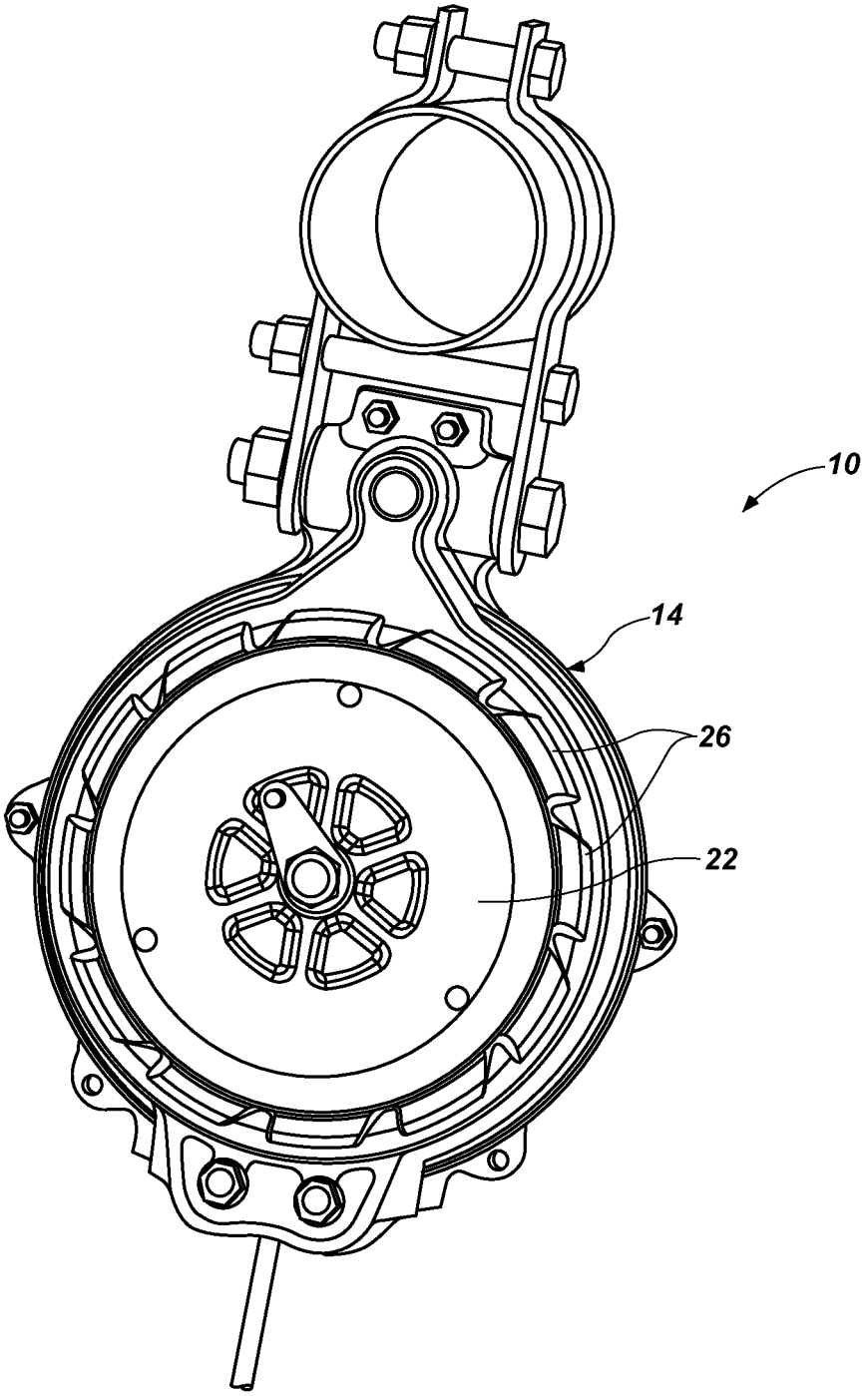
FIG. 1A illustrates a rear view of an auto-arresting safety device in accordance with one exemplary embodiment.

As used herein, the term "substantially" refers to the complete or nearly complete extent or degree of an action, characteristic, property, state, structure, item, or result. For example, an object that is "substantially" enclosed would mean that the object is either completely enclosed or nearly completely enclosed. The exact allowable degree of deviation from absolute completeness may in some cases depend on the specific context. However, generally speaking the nearness of completion will be so as to have the same overall result as if absolute and total completion were obtained. The use of "substantially" is equally applicable when used in a negative connotation to refer to the complete or near complete lack of an action, characteristic, property, state, structure, item, or result.

An initial overview of technology embodiments is provided below and then specific technology embodiments are described in further detail later. This initial summary is intended to aid readers in understanding the technology more quickly but is not intended to identify key features or essential features of the technology nor is it intended to limit the scope of the claimed subject matter.

In one aspect, the present invention resides in an auto-arresting safety device, comprising a housing; a fall arrest system supported by the housing, and having a first component moveable with respect to a second component, the fall arrest system being actuatable in response to a load to arrest movement of the first component relative to the second component, the fall arrest system being resettable to restore movement of the first component relative to the second component upon the load being at least partially removed; and a disabling system operable to prevent resetting of the fall arrest system upon the load exceeding a threshold load, such that, when actuated, the disabling system renders the device inoperable.

The present invention also resides in a method for facilitating the disabling of an auto-arresting safety device, comprising configuring an auto-arresting safety device to comprise a fall arrest system actuatable in response to a load to arrest a fall, and a disabling system that prevents resetting of the fall arrest system; and facilitating actuation of the disabling system in response to the load exceeding a threshold load, wherein the safety device is rendered inoperable. The step of facilitating can be accomplished by designing and configuring the auto-arresting safety device in a particular way, such that actuation of the disabling system is made possible during operation of the safety device. For example, the step of facilitating can include configuring the auto-arresting safety device in accordance with one of the many embodiments discussed herein, and then facilitating actuation of the disabling systems as described.

In terms of the threshold load, this load can be prescribed or determined beforehand, and can vary depending upon the particular type of safety device being used, the application of the safety device, the object being supported, etc. In general, the threshold load will define an applied load to the safety device that activates the disabling system, that creates an unresettable locking condition that prevents the device from being reset and once again being operable. Any loads below this threshold load will permit the safety device to function as intended, including being able to be reset if desired. It is noted that there are loads that the safety device may be subjected to during a fall arrest that are insufficient to activate the disabling system or to override or disable the resettable function of the device. In these instances, it is intended that these loads will also be insufficient to reduce the effectiveness of the safety device, and thus the device may be reset and put back into service with confidence that it is safe. In terms of establishing the threshold load, those skilled in the art will recognize that design considerations can be analyzed and evaluated for each type of safety device, application, object to be supported, etc., with different threshold loads being determined for each.

Moreover, unlike many prior fall arrest devices, the safety devices of the present invention do not necessarily employ dampening or load dissipating features, nor are these functions required or necessary when actuating either the fall arrest systems or the disabling systems discussed herein. This is largely due to the inanimate nature of the objects and associated loads supported by the safety device. For example, steel structures can withstand much greater dynamic force than a person without damage. Removing these features and corresponding functions from safety devices facilitates quicker, harder stops. Nonetheless, it is contemplated that such dampening and load dissipating functions could be implemented into a safety device along with a disabling system, if so desired. For example, a dampening system can greatly reduce the dynamic loads on the structure, which can result in a higher overall load capacity. A dampening system may also help prevent or reduce resulting failure of other parts of the system being arrested by reducing the dynamic loads.

Although examples of auto-arresting safety devices are provided below to assist in disclosing and teaching the present invention disabling systems, those specifically discussed below and shown in the drawings are not meant to be limiting in any way. Indeed, the present invention contemplates the use of disabling systems on or within a variety of different types of safety devices. Specifically, the present invention contemplates any type of disabling system that can be employed to create an unresettable locking condition within an associated safety device upon the safety device experiencing a load exceeding a threshold load, thereby locking the safety device and rendering it inoperable. As it is not practical to illustrate and describe all of the possible designs of disabling systems employed to operate with the various types of safety devices, the scope of the claims should not be limited to the specific embodiments discussed herein.

Figure 1B:
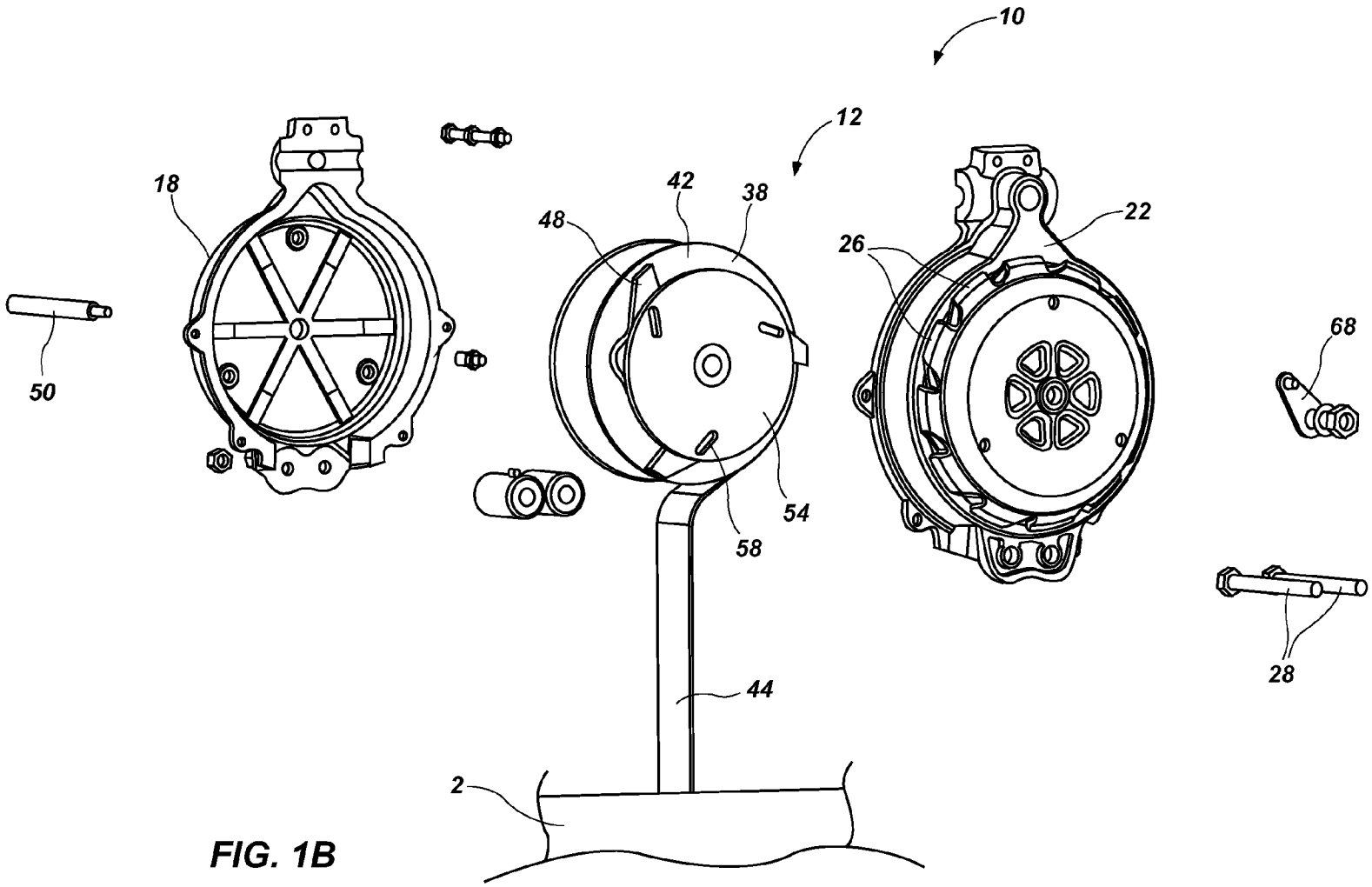
FIG. 1B illustrates an exploded perspective view of the auto-arresting safety device of FIG. 1.

With reference to FIGS. 1A and 1B, illustrated is an auto-arresting safety device in accordance with one exemplary embodiment configured to arrest a freefalling load. The safety device is based on an inertia reacting, pawl actuating, self-resetting device. In this particular embodiment, the auto-arresting safety device comprises a design similar to the Autoloc2 safety device sold by LynRus of Utah. The safety device 10 comprises a housing 14 consisting of a first shell portion 18 and a second shell portion 22 that mate together to enclose a fall arrest system 12 and a disabling system (not shown), each of which are discussed in more detail below. The first and second shell portions 18 and 22 can be secured together with a fastener 28, such as a bolt, screw, etc.

The housing 14, and particularly the second shell portion 22, can comprise a series of lugs formed in an interior surface that extend around the housing 14. The lugs can be adapted to receive or engage one or more pawls, as will be described below. The pawls can be pivotally coupled about the drum or the housing depending upon the particular embodiment of the safety device. The at least one pawl can be positionable in or between a retracted position and an extended position engageable with one of the lugs in response to a load to facilitate arresting of rotation of the drum relative to the housing upon activation of the fall arrest system.

As will be appreciated by those skilled in the art, the term lug is not intended to be limiting in any way. Indeed, lugs can comprise or include lugs, teeth, tabs, notches, etc. Essentially, a lug can comprise a variety of structures capable of interfacing with a pawl (or like structure) as intended herein, namely to facilitate fall arrest functionality within and/or disabling of the safety device. Likewise, the term "pawl" is not intended to be limiting in any way, as pawls can comprise or include pawls, dogs, rockers, etc. Essentially a pawl can comprise a variety of structures capable of interfacing with a lug (or like structure) as intended herein.

The fall arrest system 12 may comprise a first component in the form of a portion of the housing, namely the second shell portion 22 having the lugs 26 formed therein. The fall arrest system 12 may further comprise a second portion in the form of a drum 38 having a drum face 42. The housing 14 and the drum 38 are moveable relative to one another. A safety line 44 may be coupled to or otherwise supported about the drum 38, wherein the safety line attaches to an object 2 (e.g., basketball backboard or standard) capable of falling, thus relating the safety device to the object 2.

The fall arrest system 12 may comprise at least one pawl 48, which may be pivotally coupled to or about the drum 38, such as about the drum face 42. The at least one pawl 48 is configured to be positionable between a retracted position (where the fall arrest device is inactive), and an extended position engageable with one of the lugs in response to a load (where the fall arrest system is actuated to arrest the fall of the object). The fall arrest system 12 may be actuated in response to the load to arrest rotation of the drum relative to the housing to arrest the fall of the object.

The fall arrest system 12 further comprises a shaft 50 extending at least partially through the housing 14 and secured by fastener 68, wherein the drum 38 is supported about the shaft 50 and rotatable relative to the housing 14. The pawl 48 is pivotally coupled to the drum 38 about the drum face 42. An inertia plate 54 having one or more slots 58 is also supported about the shaft 50. The inertia plate 54 is rotatably supported and biased about the drum 38, and is operable to position the pawl 48 between a retracted position and an extended position engageable with the lugs 26 upon actuation of the fall arrest system 12 resulting from a force being applied to the safety device 10 through the safety line 44.

The fall arrest system 12 may further comprise a biased pawl actuator operable with the pawl 48 and the inertia plate 54 to assist in disengaging the pawl 48 from the lugs 26 in certain conditions upon removal or sufficient reduction of the force being applied to the safety device.

A more detailed explanation of an auto-arresting safety device having some of the features described above and shown in FIGS. 1A and 1B can be found in U.S. Pat. No. 4,913,371 to Margetts, which is incorporated by reference in its entirety herein.

Described below are several exemplary embodiments of disabling systems for use with various types of auto-arresting safety devices, such as the one discussed above. These examples are not to be construed as limiting in any way, and are to be considered merely representative of some of the ways in which the present invention may be practiced.

With reference to FIGS. 2A-2E, illustrated is an auto-arresting safety device similar to the one discussed above and illustrated in FIGS. 1 and 2. The auto-arresting safety device 110 is shown as further comprising a disabling system 170 in accordance with one exemplary embodiment of the present invention. In this particular embodiment, the disabling system 170 comprises a post 172 supported about and extending from a drum face 142 of a drum 138. A pawl 148 is pivotally supported about the post 172. The pawl 148 comprises a post hole 174 formed therein near one end, wherein the post hole 174 is sized and configured to receive the post 172 and to facilitate pivoting of the pawl 148 about the post 172. The disabling system 170 further comprises a disabling hole 176 formed in the pawl 148 adjacent the post hole 174, such that the two holes overlap one another to some extent. The disabling hole 176 comprises a cross-sectional dimension or size (e.g., diameter, area, etc.) that is smaller than the cross-sectional dimension or size of the post 172. The disabling hole 176 may comprise a circular, slotted or other configuration capable of receiving the post in response to the applied threshold load to the safety device 110.

Figure 2A:
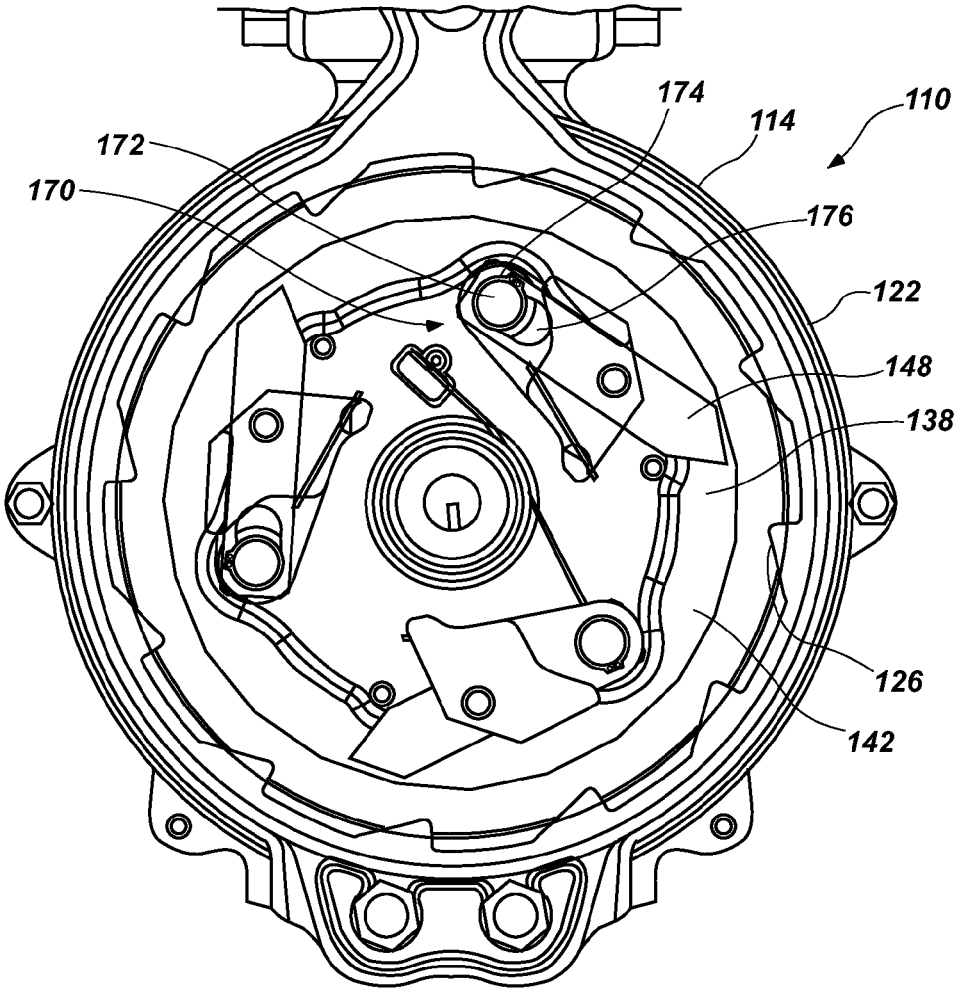
FIG. 2A illustrates a detailed rear view of an auto-arresting safety device having a disabling system in accordance with one exemplary embodiment of the present invention, wherein the housing of the device is partially hidden to show the internal systems of the device, as well as the lugs formed into the housing, and wherein the disabling system is shown in an inactive state, and the pawls in a retracted position disengaged from the lugs.
Figure 2B:
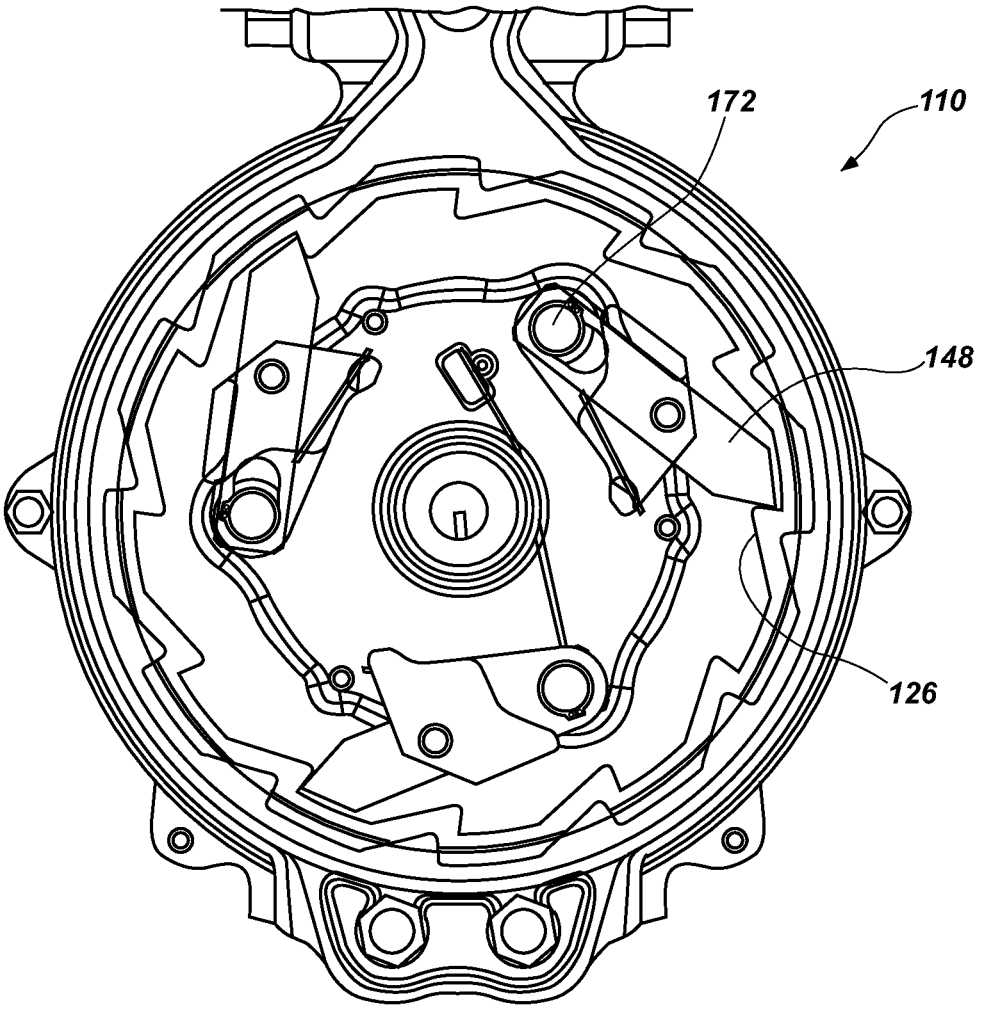
FIG. 2B illustrates the auto-arresting safety device and disabling system of FIG. 2A, wherein the housing of the device is partially hidden to show the internal systems of the device, as well as the lugs formed into the housing, and wherein the disabling system is shown inactive and the pawls in an extended position engaged with the lugs, such as is the case when the device operates to arrest a fall.
Figure 2C:
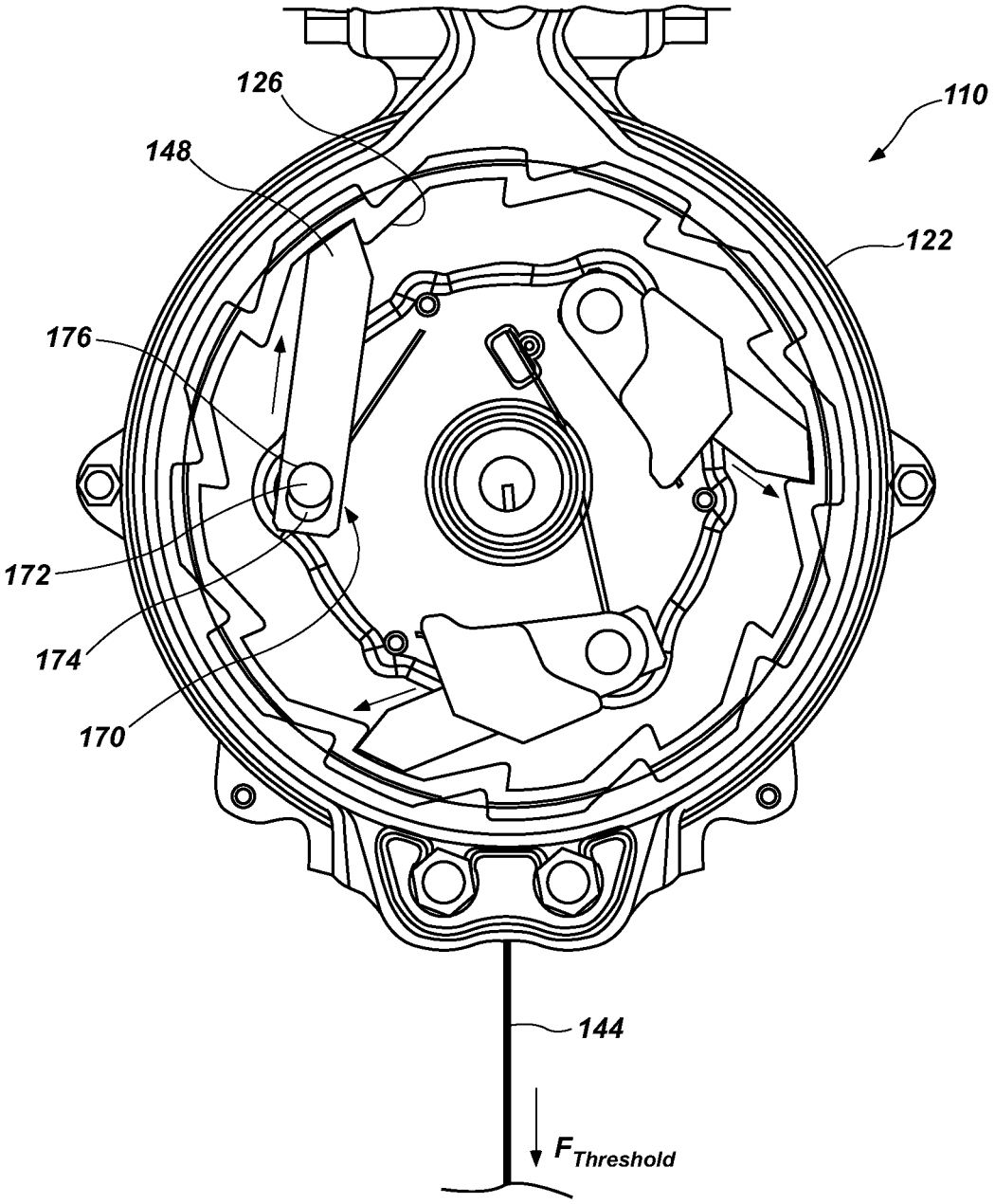
FIG. 2C illustrates the auto-arresting safety device and disabling system of FIG. 2A, wherein the housing of the device is partially hidden to show the internal systems of the device, as well as the lugs formed into the housing, and one of the pawl actuators is hidden, and wherein the pawls are shown in an extended position engaged with the lugs, and wherein the disabling system is shown in an active state to prevent resetting of the device.

In operation, the disabling system 170 is only actuated upon the safety device 110 being subjected to a threshold load (i.e., a disabling or safety load). If the safety device 110 experiences loads less than the threshold load, the safety device 110 may be reset and put back into service. In other words, loads less than the predetermined or designated threshold load will not actuate the disabling system 170, which would render the device inoperable. FIG. 2A shows the safety device 110 with the fall arrest system 112 in an inactive state, with the pawls (see pawl 148 as one of three pawls) in a retracted position away from or disengaged from the lugs (see lug 126 as one of the plurality of lugs arrayed about the second shell 122). FIG. 2B shows the safety device 110 with the fall arrest system 112 actuated and functioning to arrest a fall by preventing further rotation of the drum 138 relative to the housing 114. In this state, the pawls are in the extended position engaged with the lugs formed into the second shell 122 of the housing 114, as facilitated by the drum 138, the inertia plate (hidden from view) and the pawl actuators (see pawl actuator 142 as one of three pawl actuators). In addition, the load conditions existing within the safety device 110 as shown in FIG. 2B are below the threshold load needed to actuate the disabling system 170. As such, once the load is reduced sufficiently or removed, the safety device 110 can be reset and returned to an inactive state.

Once the safety device 110 is subjected to a load that exceeds the threshold load, not only is the fall arrest system 112 actuated, but the disabling system 170 is actuated as well (not necessarily at the same time). In this case, with the pawl 148 in an extended position and engaged with one of the lugs 126 upon actuation of the fall arrest system 112 (see FIG. 2C), the forces applied to the safety device 110 through the safety line 144 can be sufficient so as to cause or force the drum 138 to further rotate. As the pawl 148 is engaged with the lugs 126, the only movement made possible is to cause the post 172 to be forced from the post hole 174 into the disabling hole 176 as shown. Because the disabling hole 176 comprises a smaller size (e.g., smaller diameter) than the post hole 174, the disabling hole 176, and the pawl 148, are plastically deformed, the result being that the pawl 148 is bound within the disabling hole 176. In this state, any further rotation of the pawl 148 is therefore prevented due to the post 172 being of a larger diameter than the disabling hold 176, and the post 172 being forced into the disabling hole 176 under force so as to deform the pawl 148 rendering it unsafe for future use within the safety system 110. The result of the post 172 being forced into the disabling hole 176 is that the pawl 148, now plastically deformed, is bound, unable to rotate about the post 172.

Figure 2D:
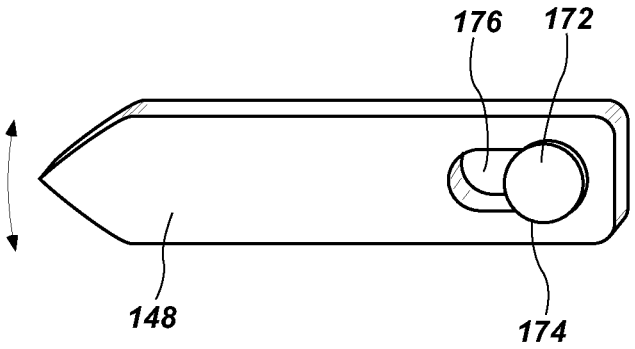
FIG. 2D illustrates a detailed view of the disabling system of the auto-arresting safety device of FIG. 2A, wherein the disabling system is shown in an inactive state with the pawl in a retracted or an extended position prior to being subjected to a threshold load.
Figure 2E:
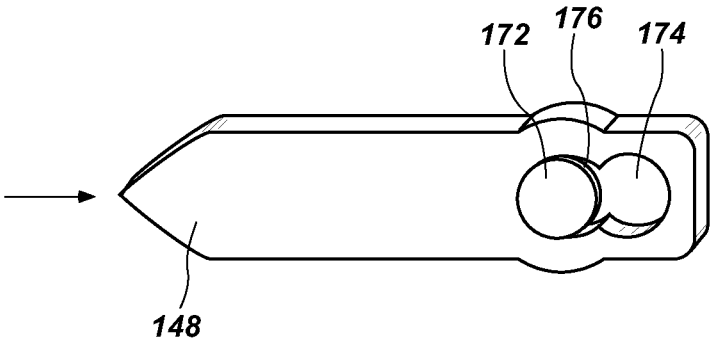
FIG. 2E illustrates a detailed view of the disabling system of the auto-arresting safety device of FIG. 2A, wherein the disabling system is shown in an active state to disable the device with the pawl in a latched position upon being subjected to a threshold load.

FIGS. 2D and 2E further illustrate a pawl 148 in a position with the post in the post hole 174 (position as shown in FIG. 2D), and in a position with the post forced into the disabling hole 176 (position as shown in FIG. 2E). These figures illustrate in more detail the transition of the post 172 from the post hole 174, where the pawl 148 is free to rotate about the post 172, to the disabling hole 176 upon activation of the disabling system 170, where the pawl 148 is bound and unable to rotate. As shown, as a threshold force is applied to or received within the safety device, and the disabling system actuated, the result is the deformation and binding of the pawl 148 due to the larger diameter post 172 being forced into the smaller diameter disabling hole 176. In essence, with the pawls in this latched position with the lugs, and the disabling system actuated, the safety device is incapable of being reset, thus rendering the safety device inoperable. To again utilize the safety device 110, various components may be replaced after inspection of the safety device. For example, the deformed pawl 148 may be replaced with a new pawl. Alternatively, an entirely new safety device may be put into service. As can be seen, the disabling system 170 ensures that the safety device 110, once subjected to a prescribed threshold load, is rendered inoperable in order to reduce or eliminate the potential of a faulty or unsafe safety device being put back into service.

It will be recognized that the threshold load can vary depending upon a variety of factors, such as the type of disabling system employed, the type of safety and fall arrest systems employed, the type of object being supported by the safety device, and others. Suffice it to say, the threshold load can be selected in order to facilitate both resettable operation of the safety device for loads below the threshold load where the disabling system is inactive, and non-resettable operation of the safety device for loads above the threshold where the disabling system is caused to be actuated resulting in inoperability of the safety device.

Figure 3A:
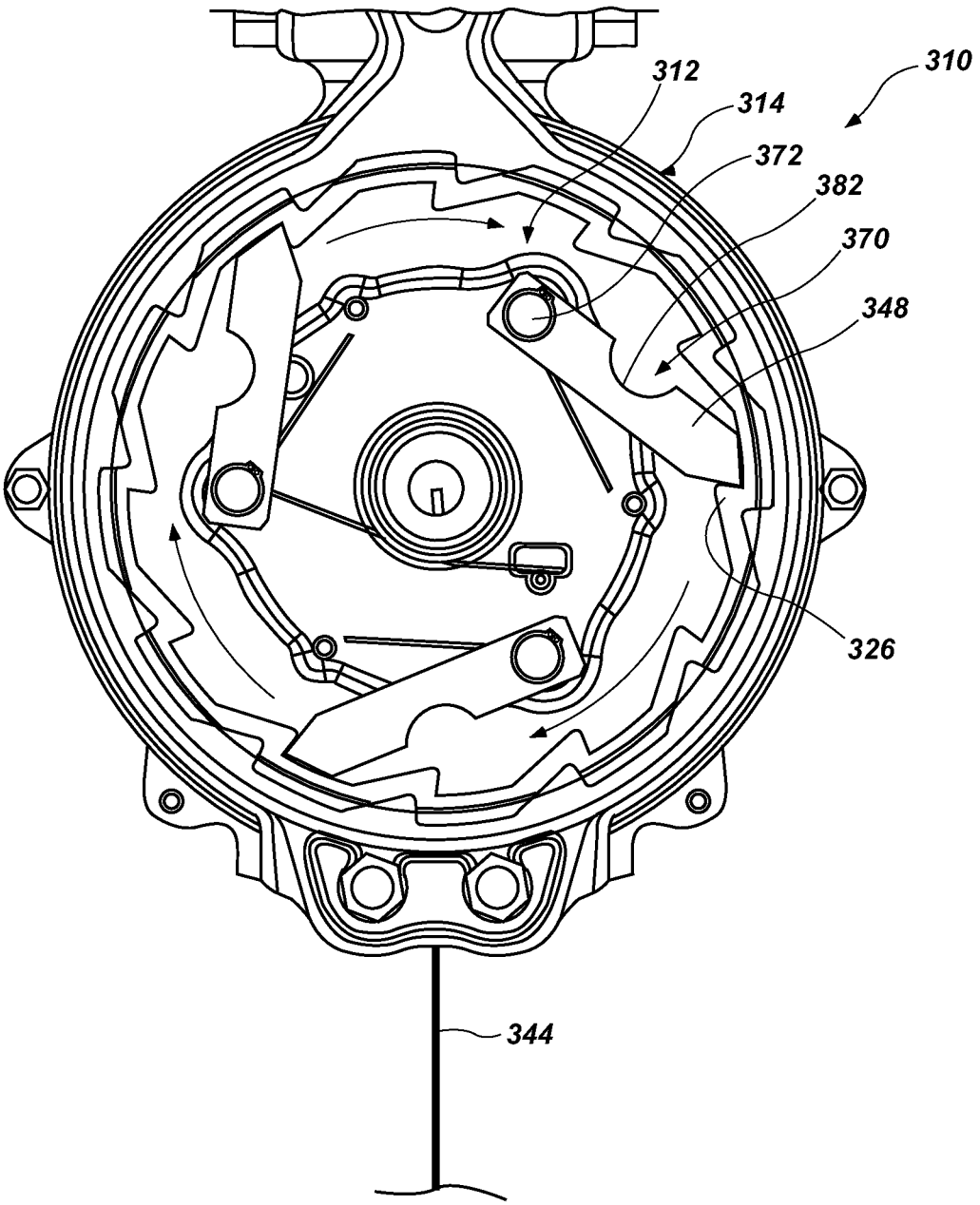
FIG. 3A illustrates a detailed rear view of an auto-arresting safety device having a disabling system in accordance with another exemplary embodiment of the present invention, wherein the housing of the device is partially hidden to show the internal systems of the device, as well as the lugs formed into the housing, and wherein the disabling system is shown in an inactive state, and the pawls in an extended position engaged with the lugs.
Figure 3B:
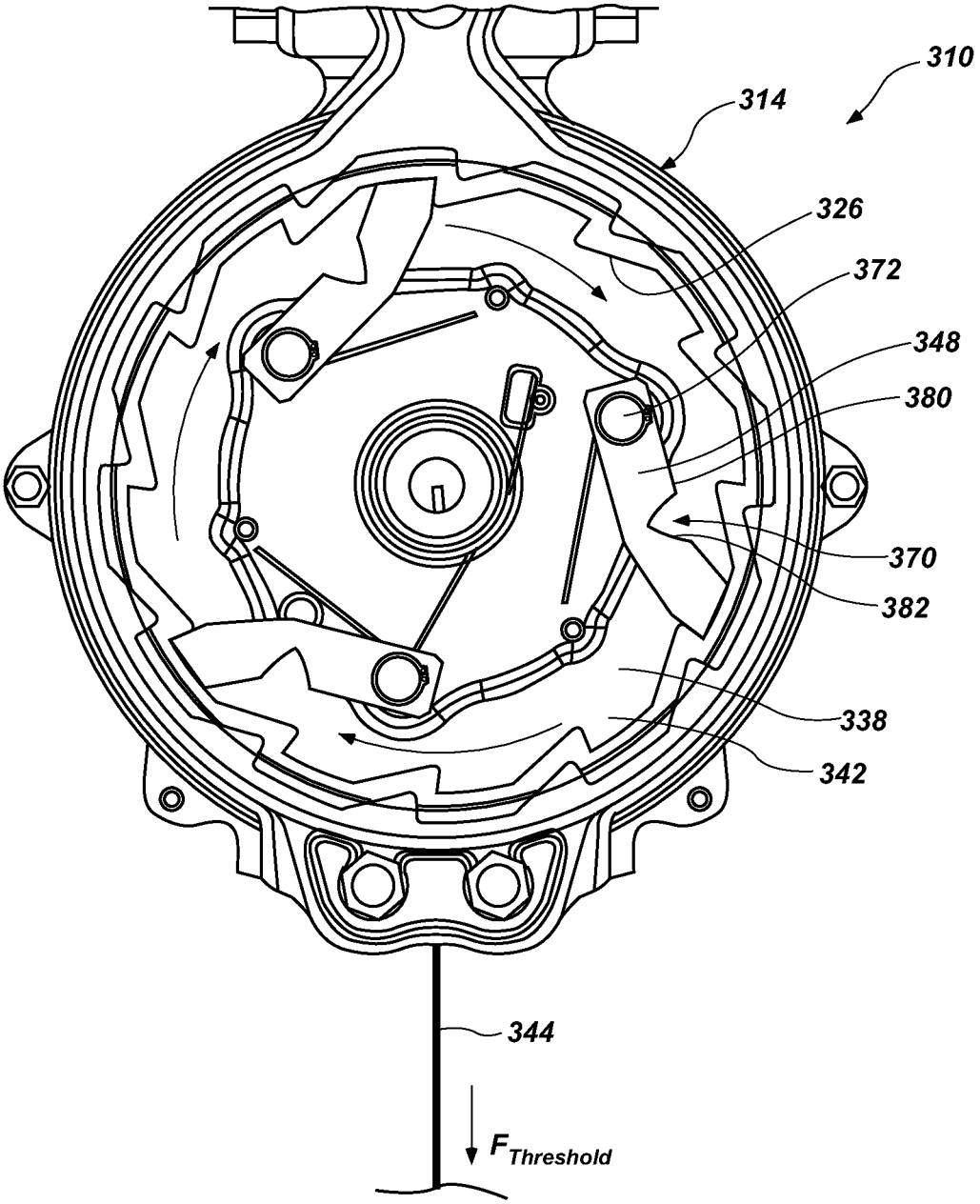
FIG. 3B illustrates the auto-arresting safety device and disabling system of FIG. 3A, wherein the housing of the device is partially hidden to show the internal systems of the device, as well as the lugs formed into the housing, and the pawl actuators are hidden, and wherein the pawls are shown in a latched position engaged with the lugs, and wherein the disabling system is shown in an active state to prevent resetting of the device.

With reference to FIGS. 3A and 3B, illustrated is an auto-arresting safety device 310 similar to the one discussed above and illustrated in FIGS. 1 and 2. The auto-arresting safety device 310 is shown as further comprising a disabling system 370 in accordance with another exemplary embodiment of the present invention. In this particular embodiment, the disabling system 370 comprises a cut-out 382 formed in at least one of the pawls 348 of the device 310 in order to create and define a weakened portion of the pawl 348, as well as to provide control over where the pawl 348 will fail and buckle under a load that exceeds the threshold load. The cut-out 382 is shown as a half-circle formed along the outer edge 380 of the pawl 348 reducing the width of the pawl about the cut-out portion. It will be recognized that the cut-out 382 may comprise different configurations or shapes. FIG. 3A illustrates the safety device 310 with the fall arrest system 312 actuated and the pawls 348 engaged with the lugs 326 in the housing 314. FIG. 3B illustrates the safety device 310 with the fall arrest system 312 and the disabling system 370 actuated in response to a load above the threshold load, thus rendering the safety device inoperable.

In operation, upon experiencing a load, the fall arrest system 312 is actuated to cause the pawls 348 to engage the lugs 326 in the housing 314. In addition, with the load exceeding the threshold load, the disabling system 370 is actuated. With the pawl 348 in the extended position engaged with one of the lugs 326, under the threshold load, the drum 338 is caused to rotate an additional rotational distance, therefore subjecting the pawl 348 to an increased force against the lug 326 in the housing 314. This increased force causes the pawl 348 to deform and bend or buckle about the cut-out 382. In doing so, the pawl 348 is caused to be reconfigured (i.e., plastically deform) and to extend abnormally and to bind with or against the housing 314, thereby preventing the safety device 310 from being reset, as well as rendering the safety device 310 inoperable.

Figure 4A:
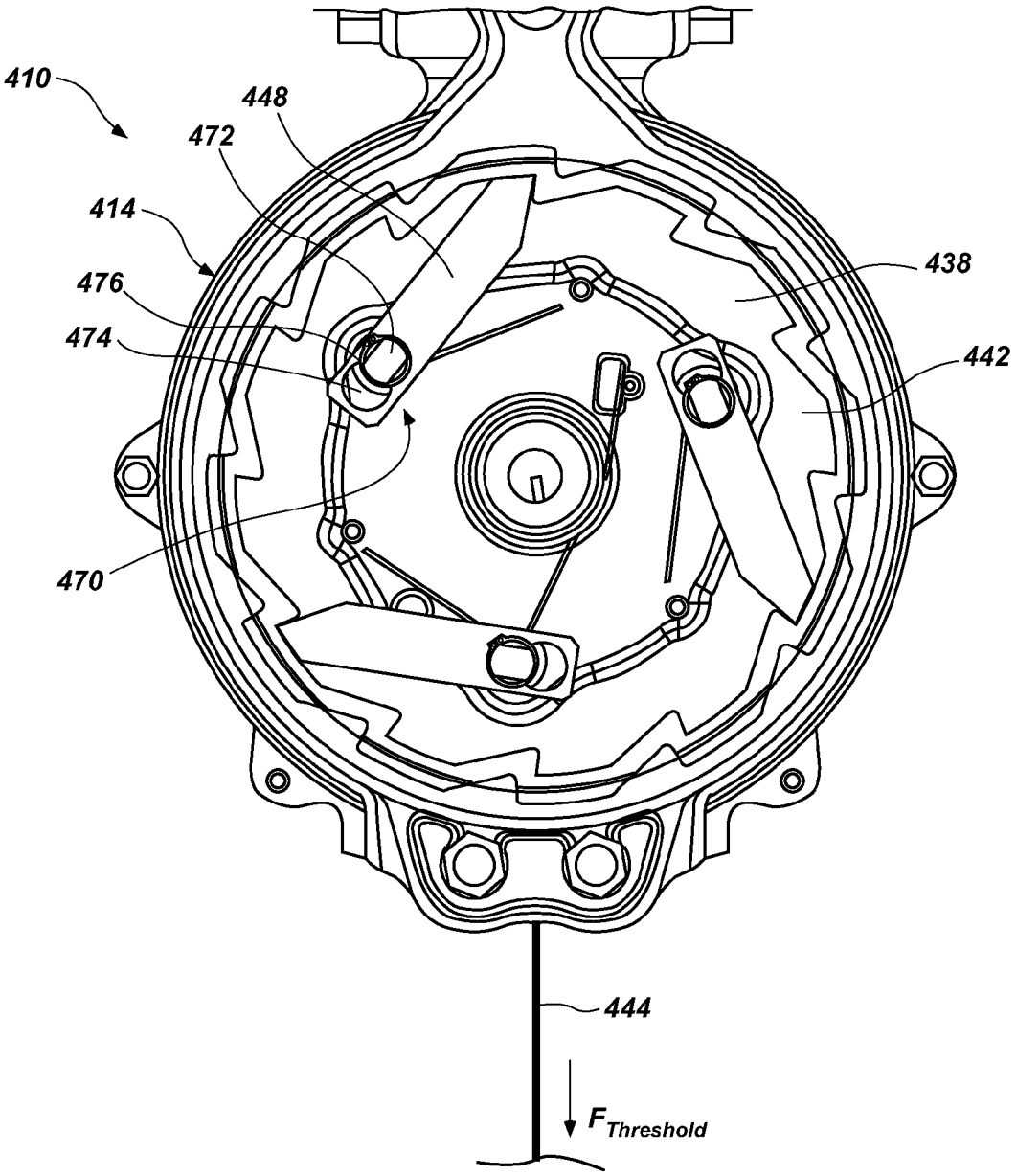
FIG. 4A illustrates a detailed rear view of an auto-arresting safety device having a disabling system in accordance with another exemplary embodiment of the present invention, wherein the housing of the device is partially hidden to show the internal systems of the device, as well as the lugs formed into the housing, and wherein the disabling system is shown in an active state to prevent resetting of the device, and the pawls in a latched position engaged with the lugs.
Figure 4B:
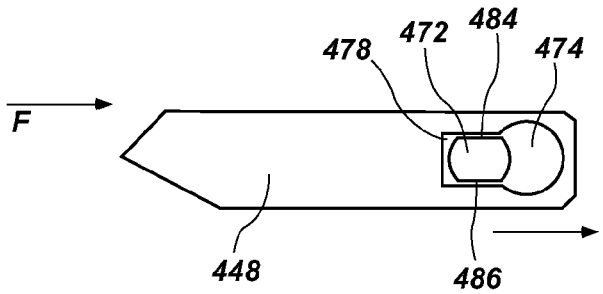
FIG. 4B illustrates a detailed view of the disabling system of FIG. 4A.

Referring now to FIGS. 4A and 4B, illustrated is an auto-arresting safety device similar to the one discussed above and illustrated in FIGS. 1 and 2. The auto-arresting safety device 410 is shown as further comprising a disabling system 470 in accordance with another exemplary embodiment of the present invention. In this particular embodiment, the disabling system 470 comprises a post 472 extending up from a drum face 442 of a rotating drum 438. The post 472 comprises at least one flat (see flats 484 and 486) formed therein. The disabling system 470 further comprises a post hole 474 formed in the pawl 448, the post 472 being sized to receive the post 472 and to facilitate pivoting of the pawl 448 about the post 472. Adjacent and merging with the post hole 474 is a disabling slot 478 also formed within the pawl 448, such that the post hole 474 and the disabling slot 478 overlap to some extent (e.g., form a keyhole configuration). The disabling slot 478 is adapted to receive the post 472 upon alignment of the flats 484 and 486 with the edges of the disabling slot.

Upon the safety device being subjected to a threshold load, the disabling system 470 is actuated. Specifically, the drum 438 is caused to further rotate, which causes the pawl 448, in its extended position engaged with the lugs 426, to be forced against the housing 414, and the flats 484 and 486 in the post 472 to align with the edges of the disabling slot 478 and the post 472 to move from the post hole 474 into the disabling slot 478. Once in place within the disabling slot 478, the flats 484 and 486 engage the edges of the slot 478 to prevent further rotation of the pawl 448, and to render the safety device inoperable. Unlike the embodiment of the disabling system discussed above and illustrated in FIGS. 2A-2E, no deformation or plastic deformation of components occurs. The post 472 and the disabling slot 478 may be configured to meet with a degree of interference or friction, but other embodiments may be configured, such that no plastic deformation takes place. As the flats 484 and 486 engage and interface with the edges of the disabling slot 478 pawl 448, any further rotation is prohibited, which further prevents or prohibits the pawl 448 from rotating. In this condition or state, the safety device 410 is incapable of being reset, and is rendered inoperable.

Figure 5A:
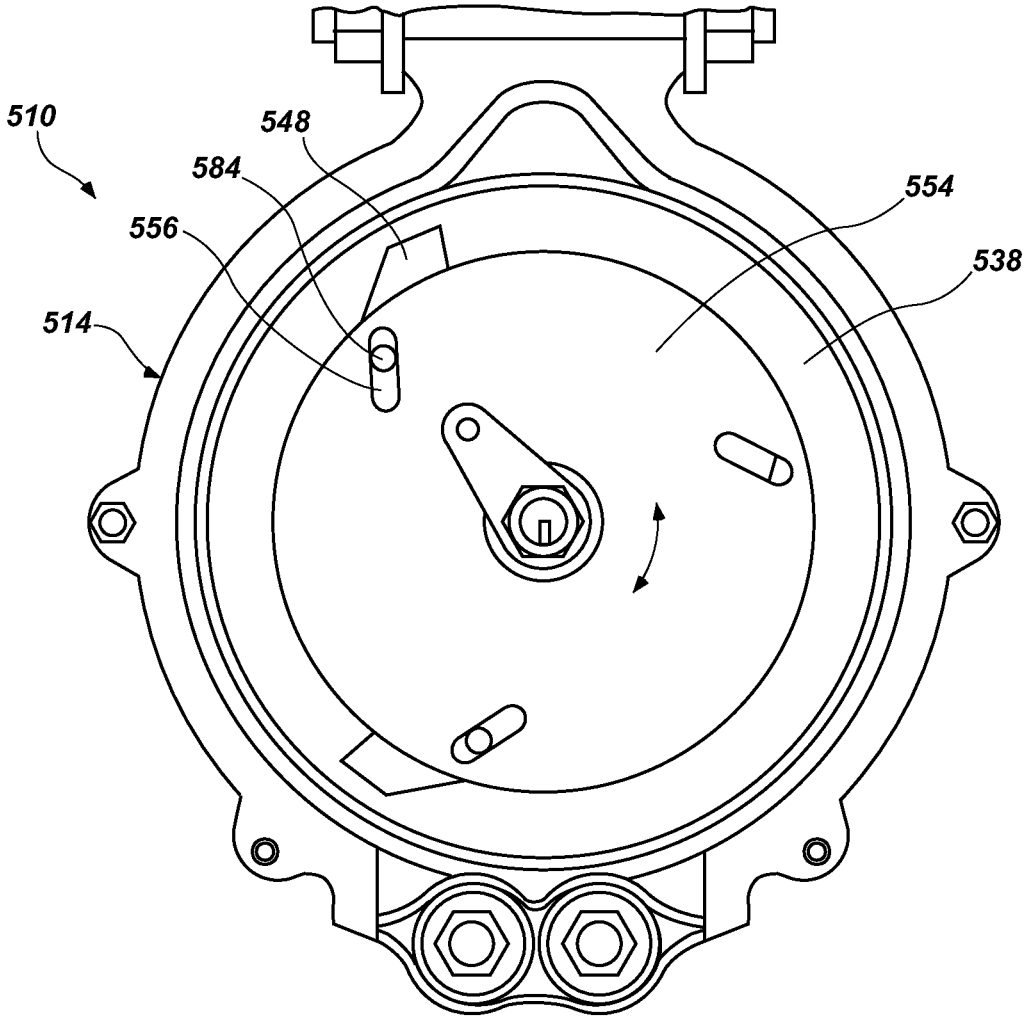
FIG. 5A illustrates a detailed rear view of an auto-arresting safety device having a disabling system in accordance with another exemplary embodiment of the present invention, wherein the housing of the device is partially hidden to show the internal systems of the device, and wherein the disabling system is shown in an inactive state.
Figure 5B:
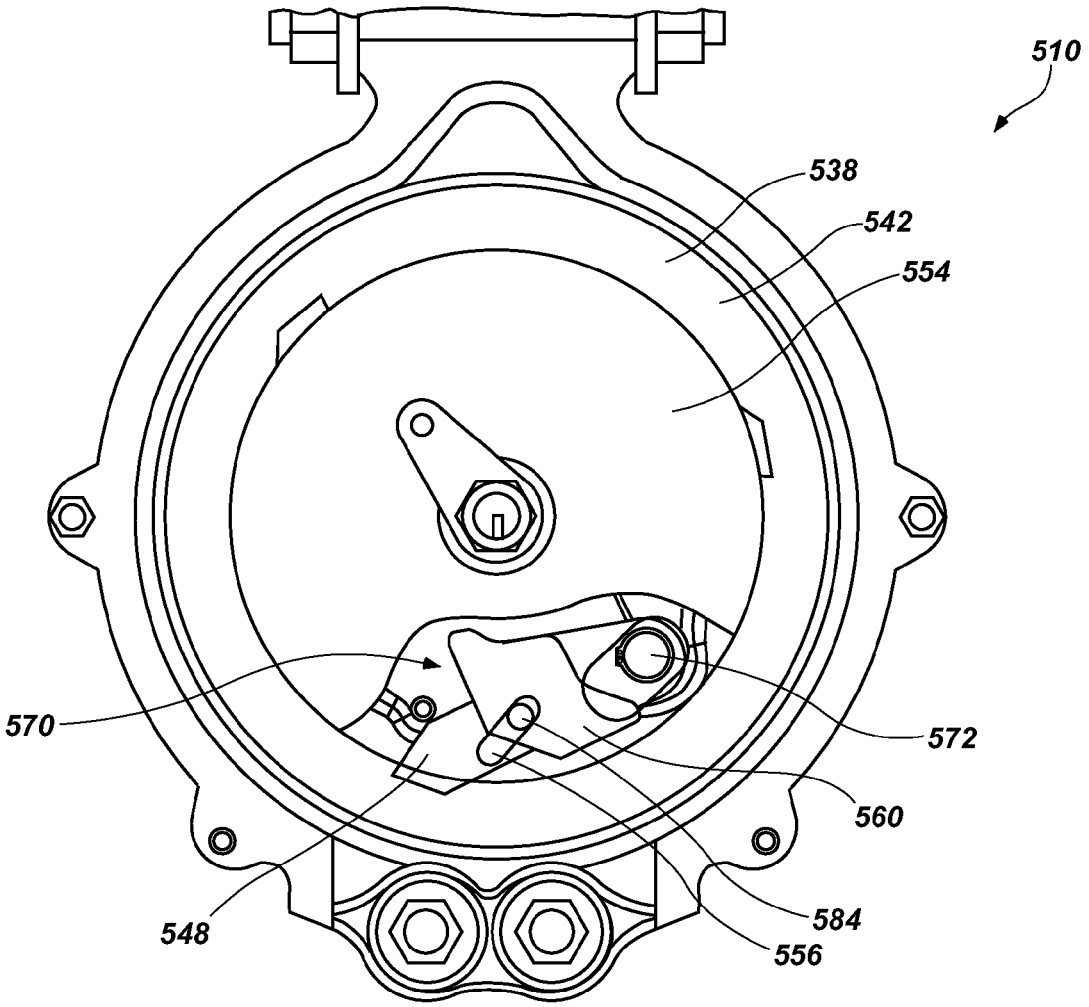
FIG. 5B illustrates the auto-arresting safety device and disabling system of FIG. 5A, with a portion of the inertia plate hidden to illustrate the pawl actuator as supporting a pin as illustrated in FIG. 5A.
Figure 5C:
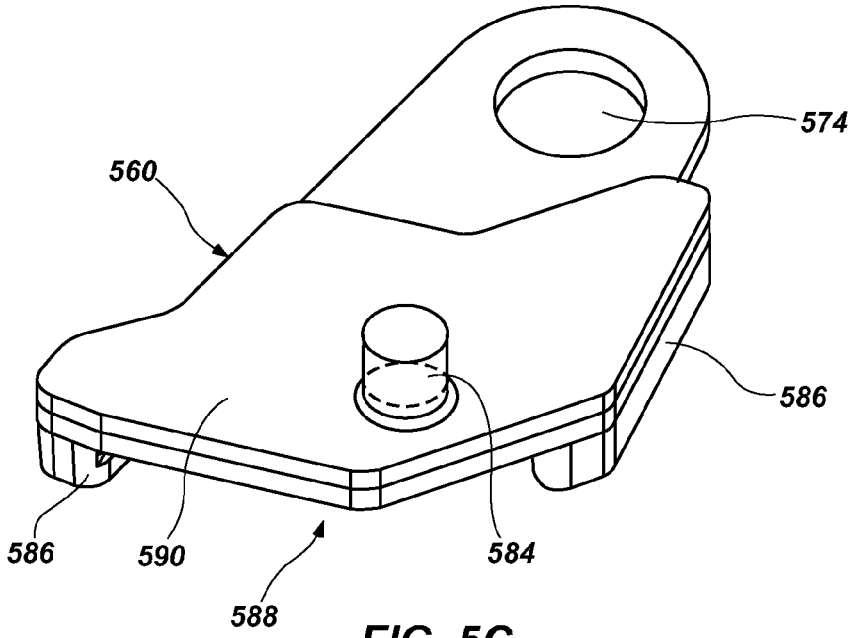
FIG. 5C illustrates the pawl actuator of FIG. 5B.

FIGS. 5A-5C illustrate an auto-arresting safety device similar to the one discussed above and illustrated in FIGS. 1 and 2. The auto-arresting safety device 510 is shown as further comprising a disabling system 570 in accordance with another exemplary embodiment of the present invention. In this particular embodiment, the disabling system 570 comprises a guide pin 584 extending up from an upper surface of a pawl actuator 560 designed to be supported about the drum 538, wherein a post 572 extending from the drum face 542 is caused to be inserted and received within a post hole 574 of the pawl actuator 560. In this configuration, the pawl actuator 560 operates to rotate in either direction about the post 572. An inertia plate 554 comprises one or more slots 556 formed therein adapted to receive the guide pin 584, wherein the guide pin 584 is sized and configured to shear upon the load within the safety device 510 exceeding the threshold load (see FIG. 5C, the non-sheared guide pin 584 being represented by solid lines, and the sheared guide pin 584 being represented by the dotted lines).

Upon the safety device 510 being subjected to a threshold load, the pawl actuator 560 is caused to exceed a designed range of normal travel as the drum 538 is caused to further rotate, thereby further rotating the pawls 548 and the pawl actuator 560. As the pawls engage the lugs 526 and prohibited from further movement or rotation, the pawl actuator 560 continues to displace beyond its normal range of travel, wherein the guide pin 584, as engaged with the slot 556 in the inertia plate 554, is forced against the edges of the slot 556 until the force becomes great enough to shear off the guide pin 584. Once the guide pin 584 is sheared off, the pawl 548 cannot be retracted from the engaged position, thus rendering the safety device inoperable.

In another aspect of this embodiment, the pawl actuator 560 may comprise one or more tabs that extend down from the plate 590 of the pawl actuator 560 (see FIG. 5C) that are designed and intended to shear. In one aspect, a single tab 586 may be employed if the direction of rotation of the drum 538 is known and set. In another aspect, two opposing tabs 586 and 587 can be formed about the pawl actuator 560 to define a channel 588. The pawl actuator 560 can be operable with the pawl 548, wherein the tabs 586 and 587 can be configured to receive the pawl 548 within the channel 588, wherein the tabs 586 and 587 extend about the edges of the pawl 548. In this position, under a threshold load, as the pawl actuator 560 continues to displace, one of the tabs 586 and 587 can be configured to shear, thus disabling the resetting function of the safety device 510 and rendering it inoperable. The shearing of the tab 586 or 587 is achieved similarly to the shearing of the guide pin 584 discussed above in that if the pawl actuator 560 is caused to displace beyond its range of acceptable and normal operating travel, such as is the case under a threshold load, the tab 586 or 587 will break off. The tabs 586 and 587 can be scored to further facilitate shearing. As such, it is contemplated herein that one or more components within the disabling system 570 can be configured to shear under a threshold load to disable the resetting function of the safety device and render it inoperable.

Figure 6A:
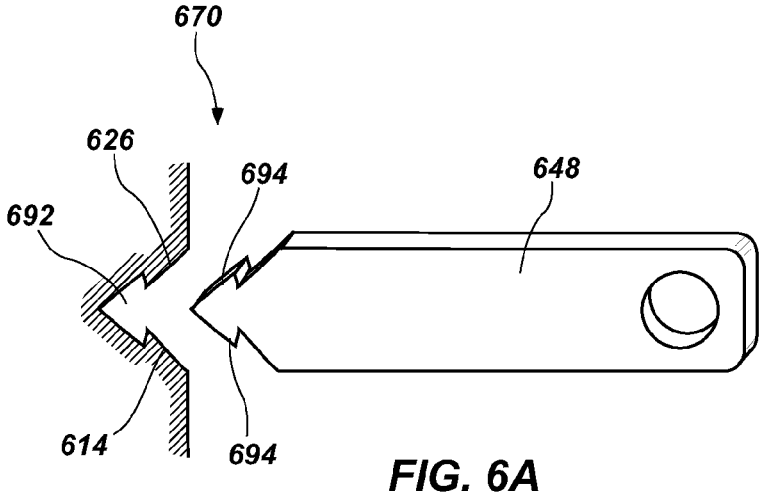
FIG. 6A illustrates a disabling system for an auto-arresting safety device in accordance with another exemplary embodiment of the present invention, wherein the disabling system is shown in an inactive state.
Figure 6B:
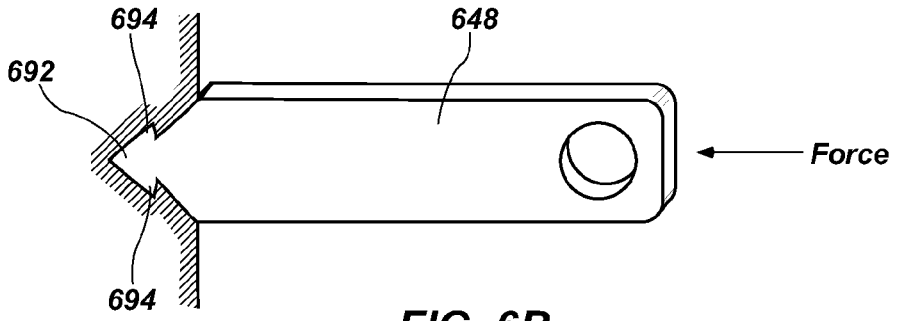
FIG. 6B illustrates the disabling system of FIG. 6A in an active state to prevent resetting of the device.

With reference to FIGS. 6A and 6B, illustrated is exemplary embodiment of a disabling system 670 for use within an auto-arresting safety device similar to the one discussed above and illustrated in FIGS. 1 and 2. In this particular embodiment, the housing 614 comprises one or more lugs 626 adapted to receive and engage a pawl 648. Formed within one or more of the lugs 626 may be a disabling receiver 692 adapted to receive a portion of the pawl 648 in response to the safety device being subjected to a threshold load. The disabling system 670 further comprises one or more barbs 694 formed on the pawl 648. Under normal operating conditions, and under loads below the threshold load, the fall arrest system may function as normal with the pawl 648 being positioned in an extended position to engage the lug 626 to arrest rotation. However, in the event of a threshold load, the disabling system 670 is actuated in response to the increased force of the pawl 648 acting on the lug 626, wherein the barbs 694 on the pawl 648 are forced into the disabling receiver 692. The barbs 694 comprise a similar configuration as the disabling receiver 692, such that the pawl 648 essentially snaps into place as the barbs 694 mate with the disabling receiver 692. Once engaged, the barbs 694 and the disabling receiver 692 prevent the release or retracting of the pawl 648 from the lug 626 and the housing 614, and prevent further rotation of the pawl 648, thus rendering the safety device inoperable. Those skilled in the art will recognize that the configuration of the barbs and the corresponding disabling receiver may comprise a number of different configurations.

Figure 7A:
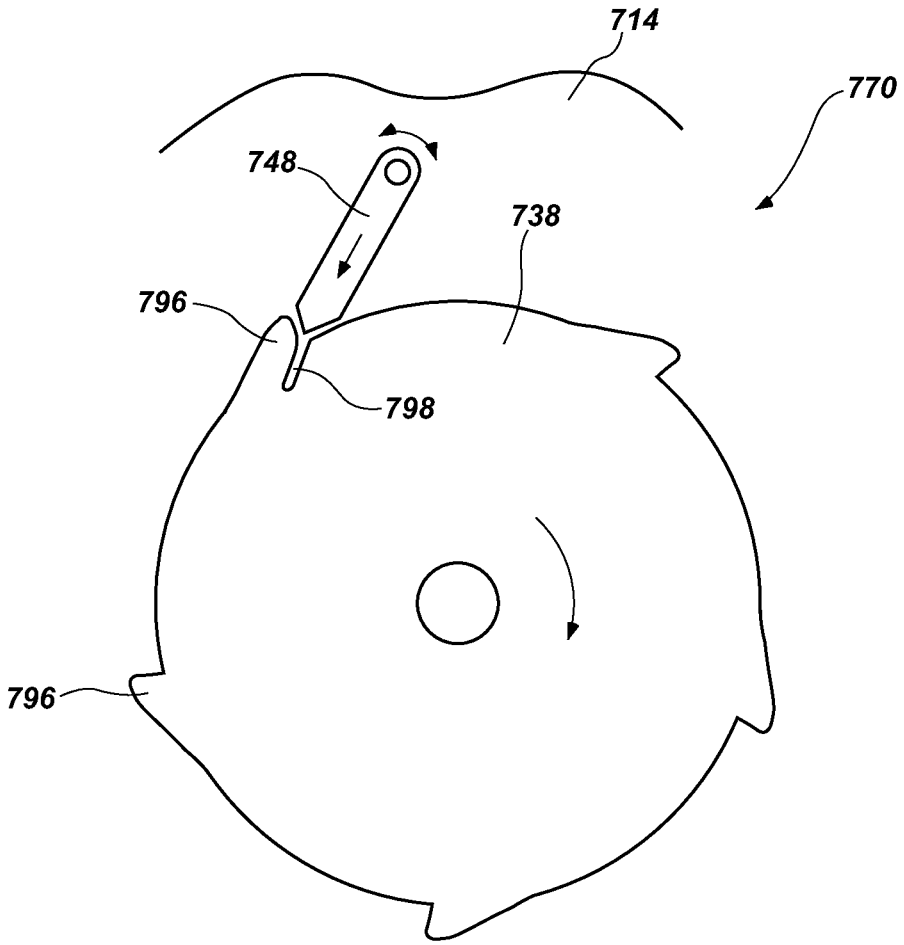
FIG. 7A illustrates a disabling system for an auto-arresting safety device in accordance with another exemplary embodiment of the present invention, wherein the disabling system is shown in an inactive state.
Figure 7B:
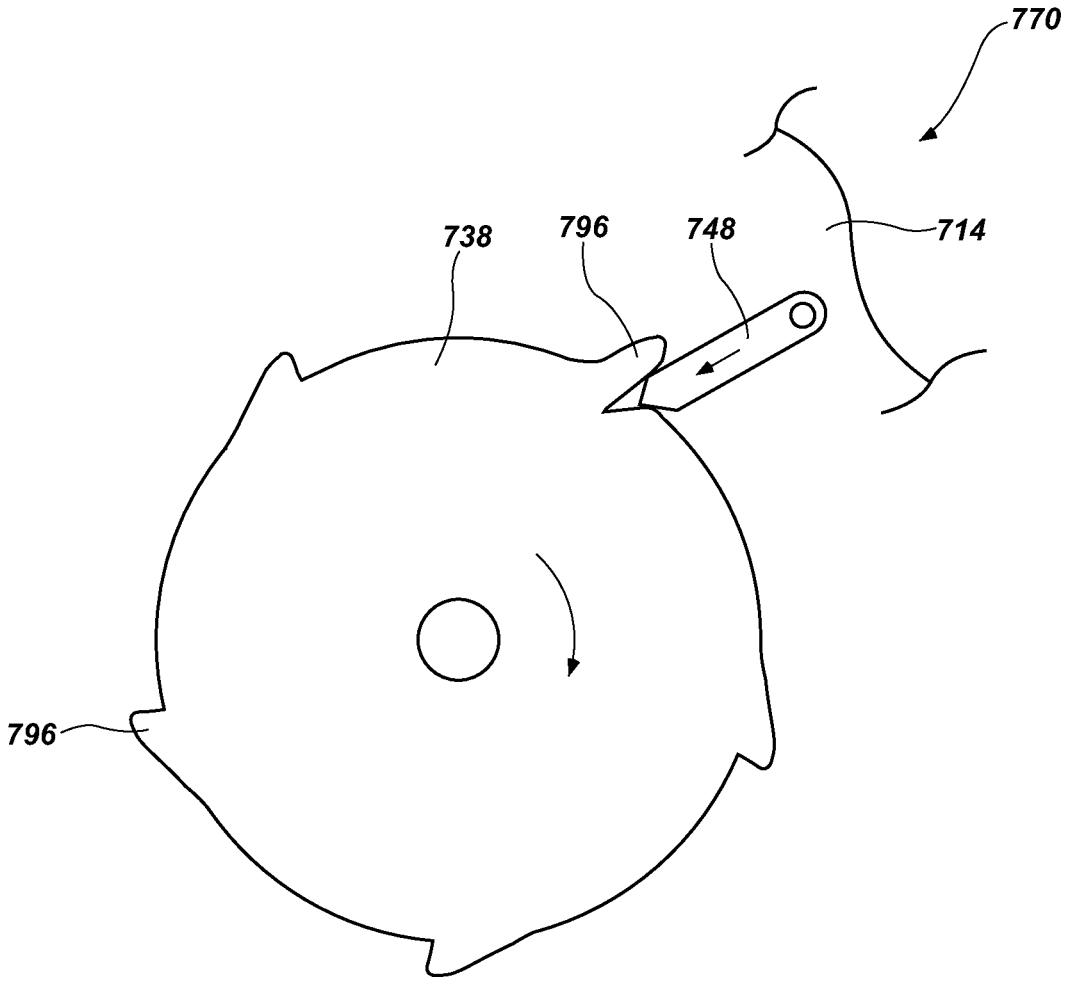
FIG. 7B illustrates the disabling system of FIG. 7A in an active state to prevent resetting of the device.

FIGS. 7A and 7B illustrate yet another exemplary embodiment of a disabling system 770 for use within an auto-arresting safety of a different type, for example, one with a pawl supported about a housing, and with a rotating drum operable to interface with the pawl. In this particular embodiment, the disabling system 770 comprises the drum 738, similar to the ones discussed above, which is rotatably supported within a housing 714. The drum 738 may comprise a plurality of lugs 796 formed about its perimeter. The drum 738 may further comprise a slot 798 formed adjacent one or more of the lugs 796 and extending into the drum 738 to facilitate deflection of the lug 796 in response to an applied load. The one or more lugs 796 on the drum 738 may be configured to engage and operate with one or more pawls 748 (shown as a rocker pawl), supported about the housing 714 and functioning as part of the disabling system in the event of a threshold load within the safety device. During normal operating conditions, the pawl 748 may engage the lug 796 to arrest rotation of the drum 738. However, in the event of the safety device being subjected to a threshold load, the pawl 748 may be forced to exert an increased force on the lug 796, thus deflecting it upward until it binds against the housing 714. In this embodiment, the drum is plastically deformed. Once the lug 796 is bound against the housing 714, the drum 738 is prohibited from further rotation, wherein the safety device cannot be reset and is rendered inoperable.

Figure 8:
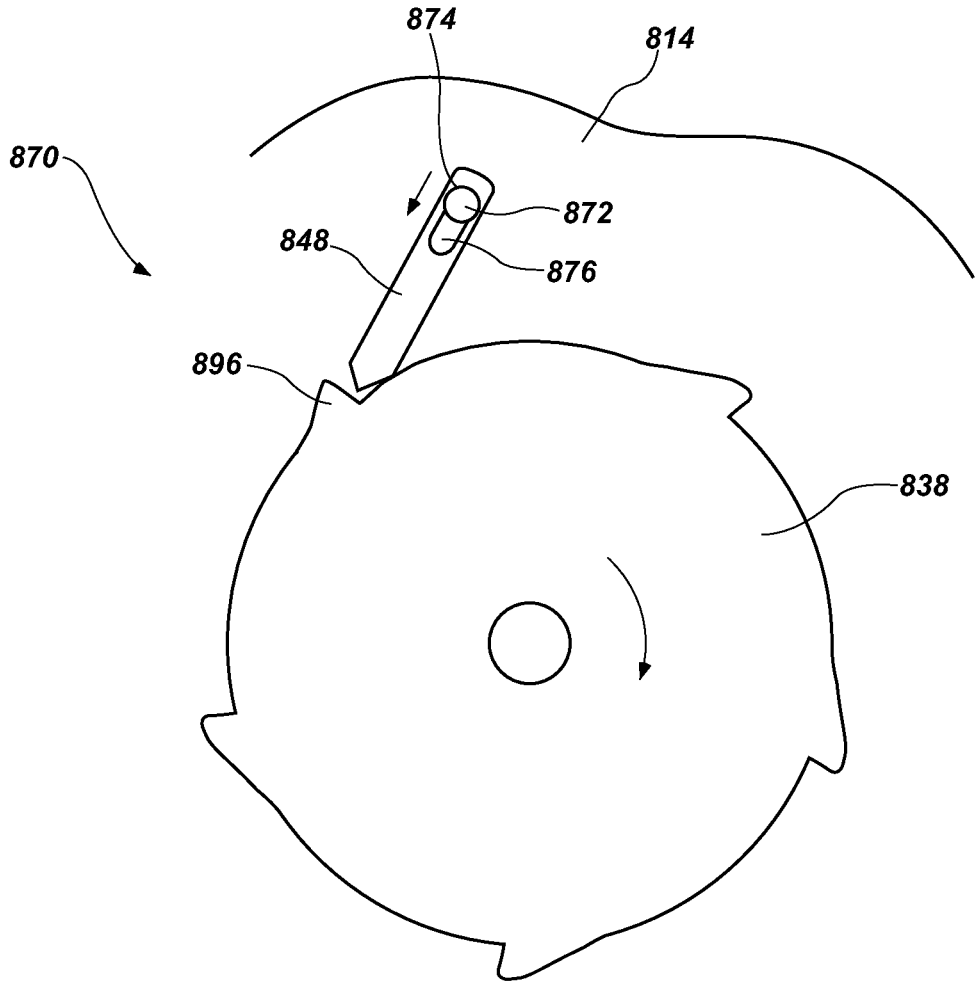
FIG. 8 illustrates a disabling system for an auto-arresting safety device in accordance with another exemplary embodiment of the present invention.

FIG. 8 illustrates another embodiment similar to that shown in FIGS. 7A and 7B, wherein a fall arrest system comprises a pawl 848 configured to operate with and engage a plurality of lugs 896 formed about a rotating drum 838 to arrest a fall upon being actuated by a load acting within the safety device. In this embodiment, however, the pawl 848 (shown as a rocker pawl) may be supported about a housing 814 with a support shaft 872 that extends through a shaft hole 874 formed within the pawl 848. The pawl 848 may be configured to rotate about the shaft 872 as received within the shaft hole 874. The pawl 848 may further comprise a disabling hole 876 (or slot) formed in the pawl 848, and positioned adjacent the shaft hole 874 such that these two overlap, with the shaft hole 874 comprising a larger diameter than the disabling hole 876. Upon application of a threshold load, the pawl 848 may be caused to engage the lugs on the drum, and further displace rather than just rotate, thereby forcing the shaft 872 into the disabling hole/slot 876, wherein the pawl 848 is plastically deformed, bound and unable to further rotate. This is similar to how the post is forced from the post hole into the disabling hole in the embodiment discussed above and shown in FIGS. 2A-2E. In this condition, the pawl 848 is plastically deformed, thus preventing the safety device from being reset, and rendering the safety device inoperable.

Those skilled in the art will recognize that the embodiments of FIGS. 7A-7B, and 8 can comprise a disabling slot rather than a disabling hole formed in the pawl, and that the shaft can comprise opposing flats, these functioning together in a similar manner as the embodiment discussed above and shown in FIGS. 4A-4B. In addition, those skilled in the art will recognize that the pawls, and the lugs operable with the pawls, in the embodiments of FIGS. 7A-7B and 8 can comprise a number of different designs and configurations.

Figure 9A:
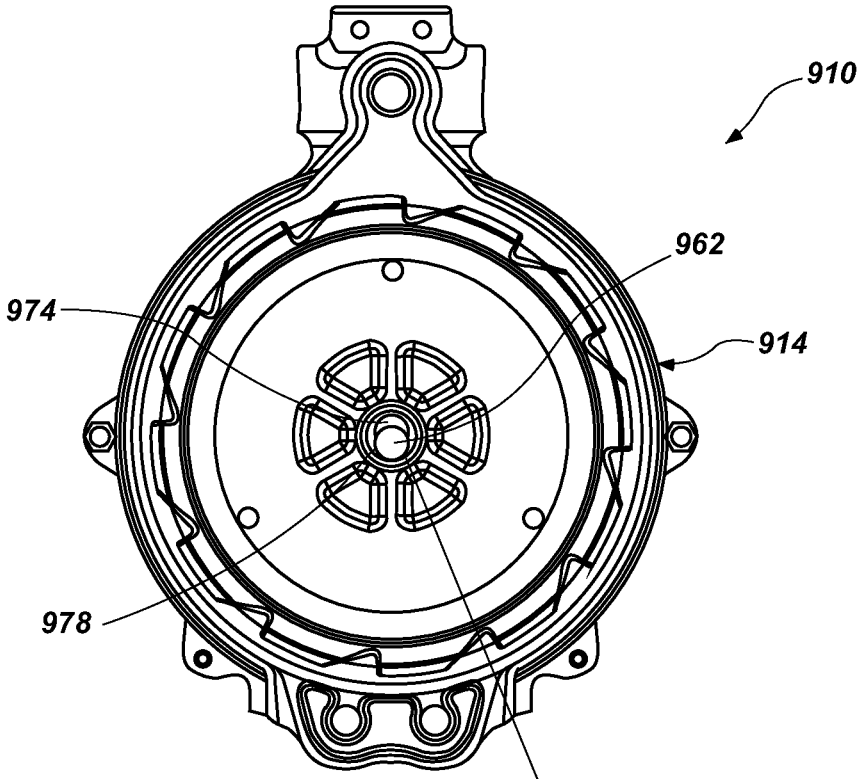
FIG. 9A illustrates a disabling system for an auto-arresting safety device in accordance with another exemplary embodiment of the present invention, wherein the disabling system is shown in an inactive state.
Figure 9B:
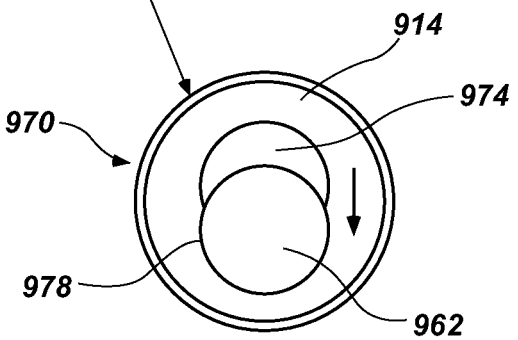
FIG. 9B illustrates a detailed view of the disabling system of FIG. 8A in an active state to prevent resetting of the device.

FIGS. 9A and 9B illustrate still another exemplary embodiment of a disabling system for use within an auto-arresting safety device. In this particular embodiment, a fall arrest system of the safety device may comprise a shaft 962 extending at least partially through the housing 914, and a drum (not shown) supported about the shaft 962 and being rotatable relative to the housing 914, with the drum supporting a safety line (no shown), similar to the auto-arresting safety device of FIGS. 1A and 1B. However, in this embodiment, the disabling system 970 may comprise a shaft hole 974 formed in the housing 914, configured to receive and support the shaft 962 relative to the housing 914 during normal operating conditions of the safety device. The disabling system 970 may further comprise the shaft 962 and a disabling hole 976 formed within the housing 914 adjacent the shaft hole 974, wherein the disabling hole 976 is adapted to receive the shaft 962 in the event of a threshold load. In one aspect, the shaft hole 974 and the disabling hole 976 are formed such that they overlap one another to some extent, with the shaft hole 974 comprising a larger diameter than the disabling hole 976, and the shaft 962 also comprising a larger diameter than the disabling hole 976. As a result, upon the safety device being subjected to a threshold load, the disabling system 970 is actuated, wherein the shaft 962 is forced into the disabling hole 974 causing the shaft 962 to be bound and the housing 914 to be deformed to some extent. In this condition, the safety device is rendered inoperable, and cannot be reset.

In some aspects, the shaft may support a spool or drum onto which the safety line is coupled or wound. Upon a threshold force being applied to the safety device, the shaft, the spool and the drum may all be caused to drop or lower within the housing as the shaft is forced into the disabling slot of the housing.

It is to be understood that the embodiments of the invention disclosed are not limited to the particular structures, process steps, or materials disclosed herein, but are extended to equivalents thereof as would be recognized by those ordinarily skilled in the relevant arts. It should also be understood that terminology employed herein is used for the purpose of describing particular embodiments only and is not intended to be limiting.

Reference throughout this specification to "one embodiment" or "an embodiment" means that a particular feature, structure, or characteristic described in connection with the embodiment is included in at least one embodiment of the present invention. Thus, appearances of the phrases "in one embodiment" or "in an embodiment" in various places throughout this specification are not necessarily all referring to the same embodiment.

As used herein, a plurality of items, structural elements, compositional elements, and/or materials may be presented in a common list for convenience. However, these lists should be construed as though each member of the list is individually identified as a separate and unique member. Thus, no individual member of such list should be construed as a de facto equivalent of any other member of the same list solely based on their presentation in a common group without indications to the contrary. In addition, various embodiments and example of the present invention may be referred to herein along with alternatives for the various components thereof. It is understood that such embodiments, examples, and alternatives are not to be construed as de facto equivalents of one another, but are to be considered as separate and autonomous representations of the present invention.

Furthermore, the described features, structures, or characteristics may be combined in any suitable manner in one or more embodiments. In the following description, numerous specific details are provided, such as examples of lengths, widths, shapes, etc., to provide a thorough understanding of embodiments of the invention. One skilled in the relevant art will recognize, however, that the invention can be practiced without one or more of the specific details, or with other methods, components, materials, etc. In other instances, well-known structures, materials, or operations are not shown or described in detail to avoid obscuring aspects of the invention.

While the forgoing examples are illustrative of the principles of the present invention in one or more particular applications, it will be apparent to those of ordinary skill in the art that numerous modifications in form, usage and details of implementation can be made without the exercise of inventive faculty, and without departing from the principles and concepts of the invention. Accordingly, it is not intended that the invention be limited, except as by the claims set forth below.

What is claimed is:

1. An auto-arresting safety device, comprising:

a fall arrest system having a first component moveable with respect to a second component, the fall arrest system being actuatable in response to a load to arrest movement of the first component relative to the second component, the fall arrest system being resettable to restore movement of the first component relative to the second component upon the load being at least partially removed; and a disabling system operable to prevent resetting of the fall arrest system upon the load exceeding a threshold load, such that, when actuated, the disabling system renders the device inoperable.

2. The auto-arresting safety device of claim 1, further comprising a housing in support of one or more components of at least one of the fall arrest system and the disabling system.

3. The auto-arresting safety device of claim 1, wherein the first component comprises at least a portion of a housing, and the second component comprises a drum having a safety line coupled thereto, the fall arrest system further comprising:

at least one pawl pivotally coupled about the drum; and a plurality of lugs formed in the housing, the at least one pawl being positionable between a retracted position and an extended position engageable with one of the lugs in response to the load to arrest rotation of the drum relative to the housing upon activation of the fall arrest system.

4. The auto-arresting safety device of claim 3, wherein the disabling system comprises:

a post extending from a drum face of the drum, the at least one pawl being pivotally supported about the post;

a post hole formed in the at least one pawl, the post hole being sized to receive the post and to facilitate pivoting of the at least one pawl about the post; and a disabling hole formed adjacent the post hole and comprising a smaller cross-sectional dimension than the post, the disabling hole being adapted to receive the post, wherein upon the load exceeding the threshold load, the disabling system is actuated with the post being forced into the disabling hole deforming and preventing further rotation of the at least one pawl and resetting of the safety device.

5. The auto-arresting safety device of claim 3, wherein the disabling system comprises:

a cut-out formed in the at least one pawl along an edge, wherein upon the load exceeding the threshold load, the disabling system is actuated with the at least one pawl being caused to deform and bend about the cut-out, such that the at least one pawl is caused to bind against the housing to prevent resetting of the safety device.

6. The auto-arresting safety device of claim 3, wherein the disabling system comprises:

a post extending from a drum face of the drum and comprising opposing flats, the at least one pawl being pivotally supported about the post;

a post hole formed in the at least one pawl, the post hole being sized to receive the post and to facilitate pivoting of the at least one pawl about the post; and a disabling slot formed adjacent the post hole adapted to receive the post upon alignment of the flats with edges of the disabling slot, wherein upon the load exceeding the threshold load, the disabling system is actuated with the post being inserted into the disabling slot, the flats engaging the edges of the disabling slot to prevent further rotation of the at least one pawl and resetting of the safety device.

7. The auto-arresting safety device of claim 3, wherein the disabling system comprises:

at least one barb formed on the at least one pawl; and a disabling receiver formed in at least one of the plurality of lugs, wherein upon the load exceeding the threshold load, the disabling system is actuated with the barb of the at least one pawl being forced into the disabling receiver deforming the at least one pawl and preventing further rotation of the at least one pawl, the barb preventing retraction of the at least one pawl from the lug.

8. The auto-arresting safety device of claim 1, wherein the first component comprises at least a portion of a housing, the fall arrest system further comprising:

a safety line;

a shaft extending at least partially through the housing;

a drum, as the second component, having a drum face and being supported about the shaft and being rotatable relative to the housing, the safety line having one end fixed about the drum;

at least one pawl pivotally coupled to the drum about the drum face;

a plurality of lugs formed in the housing, the at least one pawl being pivotal between a retracted position and an extended position engageable with the lugs to arrest rotation of the drum relative to the housing upon activation of the fall arrest system;

an inertia plate rotatable and biased about the drum, the inertia plate being operable to position the pawls between a retracted position and an extended position engageable with the lugs upon activation of the fall arrest system resulting from the force being applied to the safety line; and a biased pawl actuator operable with the at least one pawl and the inertia plate.

9. The auto-arresting safety device of claim 8, wherein the disabling system comprises:

a guide pin extending from an upper surface of the pawl actuator; and a slot formed in the inertia plate, and adapted to receive the guide pin, wherein the guide pin is sized and configured to shear upon the load exceeding the threshold load, wherein upon the load exceeding the threshold load, the disabling system is actuated with the guide pin being sheared off, such that the at least one pawl is caused to bind against the housing.

10. The auto-arresting safety device of claim 8, wherein the disabling system comprises the pawl actuator and a tab extending down from a surface of the pawl actuator, wherein upon the load exceeding the threshold load the disabling system is actuated with the pawl actuator displacing to cause the tab to break off, such that the at least one pawl is caused to bind against the housing.

11. The auto-arresting safety device of claim 1, wherein the first component comprises at least a portion of the housing, and the second component comprises a drum, the fall arrest system further comprising:

at least one lug formed about a perimeter of the drum;

a pawl pivotally supported about the housing, and configured to engage the at least one lug; and a slot formed adjacent the at least one lug and extending into the drum to facilitate deflection of the lug in response to an applied load from the pawl, wherein upon the applied load exceeding the threshold load, the disabling system is actuated with the pawl deflecting the at least one lug, such that the deflected lug binds against the housing.

12. The auto-arresting safety device of claim 1, wherein the fall arrest system further comprises a shaft extending at least partially through the housing, and a drum supported about the shall, and being rotatable relative to the housing, the drum supporting a safety line, wherein the disabling system further comprises:

a shaft hole formed in the housing, and configured to receive and support the shaft relative to the housing;

a disabling hole formed in the housing adjacent the shaft hole and comprising a smaller cross-sectional dimension than that of the shaft, the disabling hole being adapted to receive the shaft, wherein upon the load exceeding the threshold load, the disabling system is actuated with the shaft being forced into the disabling hole, such that the fall arrest system is caused to bind against the housing.

13. A method for facilitating the disabling of an auto-arresting safety device, comprising:

configuring an auto-arresting safety device to comprise:

a resettable fall arrest system actuatable in response to a load to arrest a fall, and a disabling system actuatable to prevent resetting of the fall arrest system; and facilitating actuation of the disabling system in response to the load exceeding a threshold load, wherein the safety device is rendered inoperable.

14. The method of claim 13, wherein the fall arrest system comprises:

at least one lug;

at least one pawl configured to engage the at least one lug.

15. The method of claim 14, wherein facilitating actuation of the disabling system comprises facilitating deforming of the at least one pawl to prevent resetting of the fall arrest system.

16. The method of claim 14, wherein facilitating actuation of the disabling system comprises facilitating deforming of the at least one lug to prevent resetting of the fall arrest system.

17. The method of claim 14, wherein facilitating actuation of the disabling system comprises facilitating preventing the at least one pawl from rotating.

18. The method of claim 14, wherein the fall arrest device further comprises a pawl actuator operable with the at least one pawl, and wherein facilitating actuation of the disabling system comprises shearing a portion of the pawl actuator in response to the threshold load.

19. The method of claim 13, further comprising configuring the auto-arresting safety device to comprise a housing in support of the fall arrest system and the disabling system.

20. The method of claim 19, wherein facilitating actuation of the disabling system comprises facilitating deforming of at least a portion of the housing.

* * * * *